United States Patent [19]

Robertson

[11] Patent Number: 4,899,893

[45] Date of Patent: Feb. 13, 1990

[54] ADJUSTABLE SPACE SAVING DEVICE

[75] Inventor: J. David Robertson, Atlanta, Ga.

[73] Assignee: The Mead Corporation, Dayton, Ohio

[21] Appl. No.: 312,441

[22] Filed: Feb. 21, 1989

[51] Int. Cl.[4] ..... A47F 1/00

[52] U.S. Cl. ..... 211/59.3

[58] Field of Search ..... 211/59.3, 51, 43; 312/45, 71

[56] References Cited

U.S. PATENT DOCUMENTS

| | | | |
|---|---|---|---|
| 2,934,212 | 4/1960 | Jacobson | 211/59.3 |
| 4,300,693 | 11/1981 | Spamer | 211/59.3 |
| 4,303,162 | 12/1981 | Suttles | 211/59.3 |

FOREIGN PATENT DOCUMENTS

| | | | |
|---|---|---|---|
| 2385365 | 12/1978 | France | 211/59.3 |
| 45-35581 | 11/1970 | Japan | 211/59.3 |

*Primary Examiner*—Robert W. Gibson, Jr.
*Attorney, Agent, or Firm*—Rodgers & Rodgers

[57] ABSTRACT

A variable number of articles of similar size and shape are maintained in a face contacting compact interrelationship by a device including an elongated base element having a flat planar upper surface, an abutment element fixed in position on the base element at one end thereof and having an upwardly projecting article engaging surface substantilly normal with the flat planar upper surface of the base element, a sled slidably mounted on the base element and having an article engaging panel projecting upwardly and in generally parallel relation with the article engaging surface of the abutment element so that one or more articles are held between the article engaging surface and the article engaging panel, movement of the sled in a direction away from the abutment element being opposed by friction between the sled and the base element.

7 Claims, 2 Drawing Sheets

ADJUSTABLE SPACE SAVING DEVICE

TECHNICAL FIELD

This invention relates to point of purchase marketing generally and is more specifically concerned with a device for holding one or more articles of similar size and configuration in a compact space saving relation. The device may be used in refrigerators in conjunction with frozen packages of pizza and the like or, if desired, is usable in connection with other packages which do not require refrigeration.

BACKGROUND ART

Known point of purchase display devices include a slidable sled spaced normally from a bumper device between which articles are displayed. Spring means may be used to urge the sled toward the bumper so that removal of a front package results in sliding movement of the remaining articles toward the front of the display and into engagement with the bumper.

SUMMARY

According to this invention in one form, one or more articles of similar size and configuration are interposed between an abutment element and a slidable sled mounted atop an elongated base element for holding the articles in closely spaced space saving relationship. According to a feature of the invention, the sled is provided with an integral transverse portion disposed above the upper surface of the base and remote from the abutment element and a transverse connecting strip integral with a part of the sled adjacent the abutment element and which underlies the base element so that a force imparted to the article engaging panel of the sled in a direction away from the abutment element is opposed due to frictional contact between the upper surface of the base element and the transverse portion of the sled as well as the frictional relationship between the lower surface of the base element and the upper surface of the transverse connecting strip. By this frictional relationship between portions of the sled and the base, the articles stacked on the device are maintained in close face contacting relation with each other.

For some applications of the invention, the sled may be biased in a direction toward the abutment element by spring means having a coiled portion disposed within a cavity formed in the sled and whose outer end portion is affixed to the base element at a point adjacent the abutment element. Such a spring biased arrangement is usable in connection with articles which are light in weight and which may be held in contact relation with each other due to automatic movement of the sled in a direction toward the abutment element as items disposed therebetween are removed.

BEST MODE OF CARRYING OUT THE INVENTION

Figure 1:
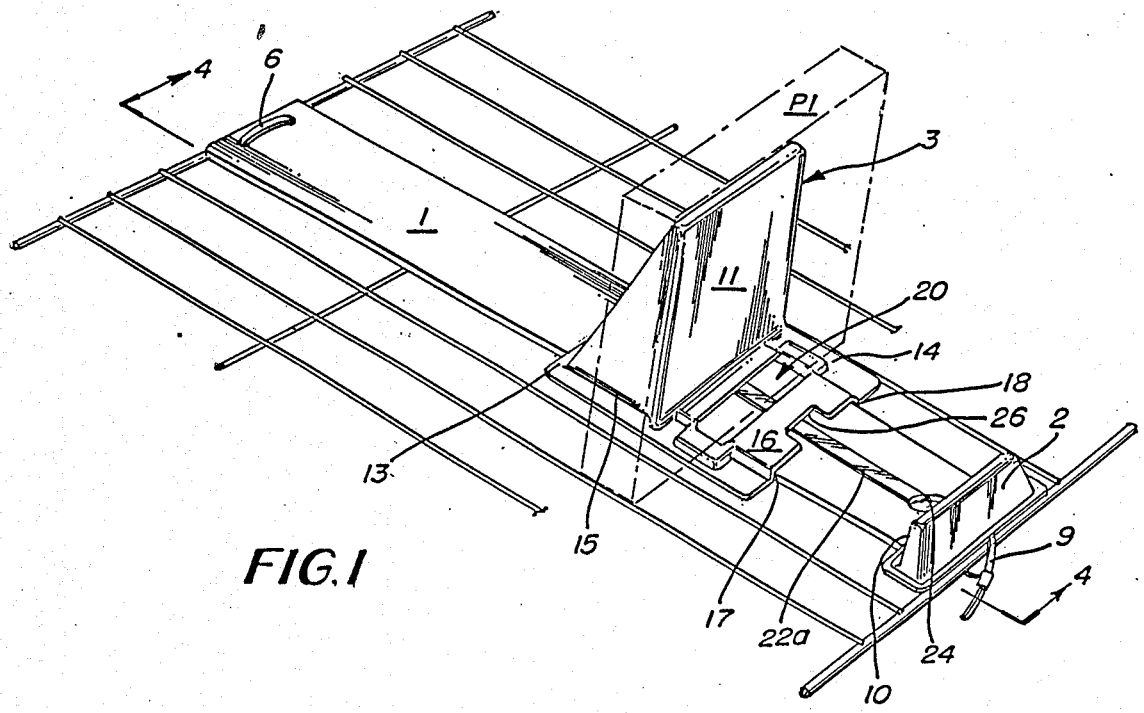
FIG. 1 is a perspective view of the device as it appears when mounted on a wire shelf of a refrigerator for example.
Figure 6:
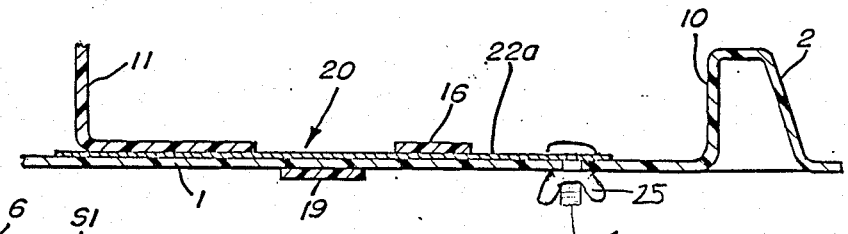
FIG. 6 is a cross sectional view taken along the line designated 6—6 in FIG. 5.
Figure 2:
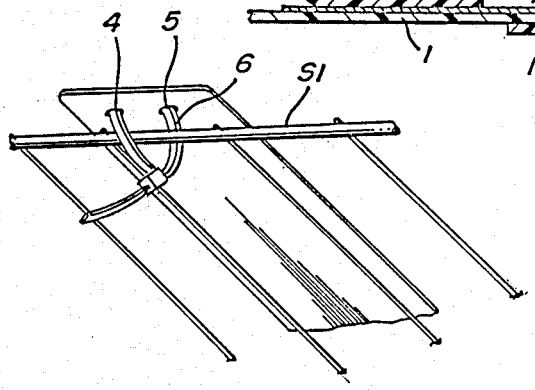
FIG. 2 is a perspective view from below of one end of the structure shown in FIG. 1 and which shows the base element of the invention secured to the wire shelf.
Figure 3:
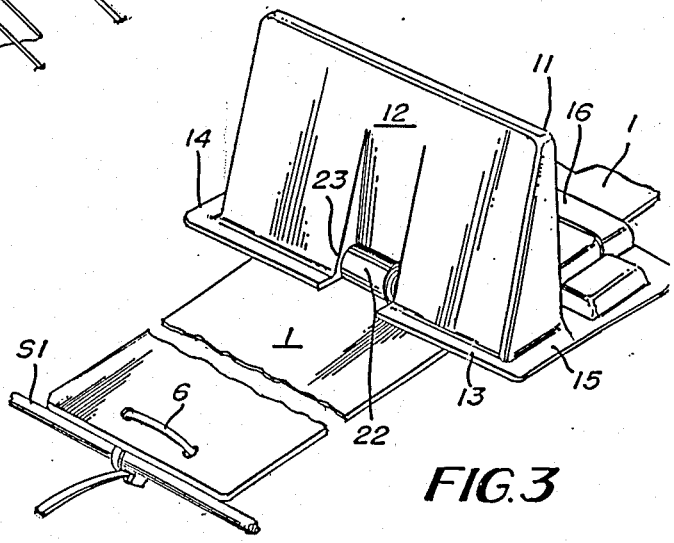
FIG. 3 is a perspective view of a portion of the structure shown in FIG. 1 but which is taken from a different vantage point.

With reference primarily to FIGS. 1 and 3, the numeral 1 designates an elongated base element having a flat planar upper surface at one end of which an abutment element 2 is rigidly affixed and on which a sled generally designated by the numeral 3 is slidably mounted.

When the device is used for display purposes in a refrigerator, for example, it ordinarily is desirable to secure the base element in fixed relation to a shelf of the refrigerator. In this connection, a pair of holes 4 and 5 are formed in the base element at one end thereof and a tie-down cord 6 is inserted through the holes 4 and 5 and disposed in adjustable enveloping relation to the shelf element designated S1. As is shown in FIGS. 4 and 5 a pair of holes 7 and 8 are formed in base 1 adjacent abutment 2 and a tie-down cord 9 is disposed in enveloping relation with shelf element S2.

Abutment element 2 includes an article engaging surface 10 which is in generally perpendicular relation to the upper planar surface of base element 1 and sled 3 includes an article engaging panel which is disposed in generally perpendicular relation to the upper planar surface of base element 1 and in general parallel relation with the article engaging surface 10 of abutment 2. Sled 3 includes a sled bracing panel 12 which is integral with article engaging panel 11 at the upper surfaces thereof. Sled bracing panel 12 extends downwardly in angular relation to panel 11 and is integrally formed with transverse portion 13. A pair of strips 14 and 15 are disposed on opposite sides of the sled 3 and arranged so that the ends thereof which are connected with transverse portion 13 are disposed above the top planar surface of the base 1 while the opposite ends of strips 14 and 15 are disposed below the lower surface of base element 1 and are interconnected by a reinforcing cross piece 16 and by downwardly extending portions 17 and 18. Strips 14 and 15 are also interconnected by a transverse connecting strip 19 which normally is disposed in closely spaced relation with the under surface of base element 1. Transverse connecting strip 19 is disposed in general coincidence with an aperture 20 formed in reinforcing cross piece 16.

Figure 4:
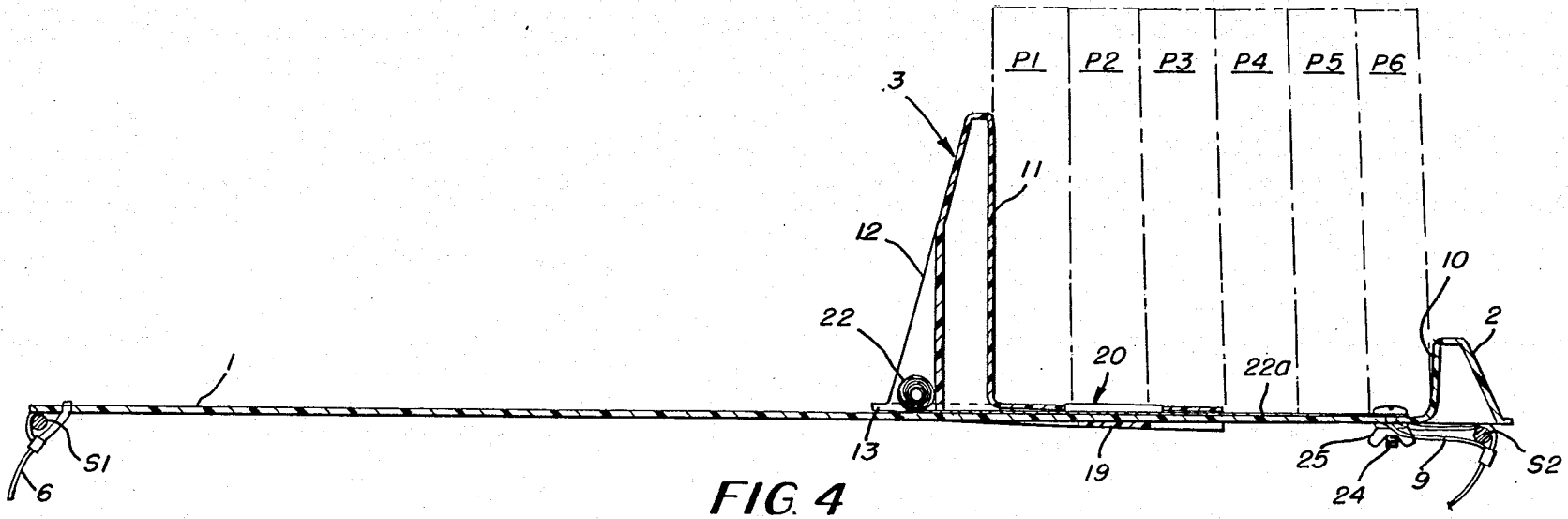
FIG. 4 is a cross sectional view of FIG. 1 taken along the line generally designated at 4—4.
Figure 5:
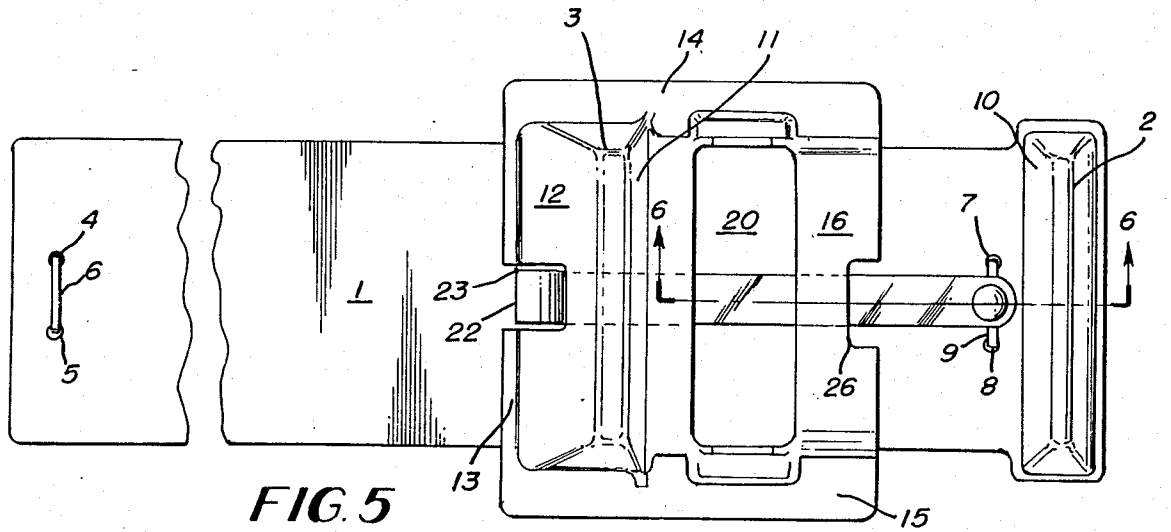
FIG. 5 is a plan view of the structure shown in FIG. 1.

In FIGS. 1 and 4, packages are shown in phantom lines and designated P1–P6.

The arrangement as described above is manually adjustable by simply sliding the sled in one direction or the other as may be required to accommodate removal or addition of packages such as P1–P6. The sled 3 is maintained in a position in which it is set manually due to the fact that the frictional relationship between the lower surface of transverse portion 13 of the sled and the upper surface of base element 1 together with friction between the upper surface of transverse connecting strip 19 and the lower surface of base element 1 so that a force imparted to the article engaging panel 11 which tends to move the sled in a direction away from abutment element 2 tends to tilt the sled in a generally counterclockwise direction as the sled is viewed in FIGS. 1 and 4. This tilting action forces the lower surface of transverse portion 13 and the upper surface of base 1 together and forces the upper surface of transverse connecting strip 19 and the lower surface of base element 1 in close contact with each other to establish frictional relationships which impede and generally prevent movement toward the left of the sled 3 as viewed for example in FIG. 4.

Where the device is intended for use with items which are light in weight and which may or may not be refrigerated, it may be desirable to use biasing means in the form of spring coil 22 disposed within cavity 23 formed in sled 3. Coil 22 is arranged with its uncoiled part disposed underneath the sled 3 and with its outer end connected by stud 24 and its associated nut 25 to base 1 so as to hold the outer end 22*a* of the spring coil 22 in fixed position adjacent the fixed abutment 2. In order to provide space for receiving the stud 24 and its associated nut 25, a notch 26 is cut out of the reinforcing cross piece 16 forming a part of sled 3. As is obvious, removal of one of the packages such as P6 shown in FIG. 4 results in movement toward the right of sled 3 due to the action of spring coil 22.

I claim:

1. An adjustable device for holding a variable number of articles of similar size and shape in a compact space saving interrelationship, said device comprising an elongated base element having a flat planar upper surface, an abutment element fixed in position on said base element at one end thereof and projecting upwardly from and having an article engaging surface disposed in substantially normal relation with said flat planar upper surface of said base element, a sled slidably mounted on said elongated base element and having an article engaging panel projecting upwardly and disposed in generally parallel relation with said article engaging surface of said abutment element, said article engaging panel and said article engaging surface being arranged to hold one or more articles disposed therebetween in flat face contacting relation with said article engaging surface and with said article engaging panel and having a transverse portion overlying said base element and remote from said abutment element and an integral transverse connecting strip on the side of said sled adjacent said abutment element and disposed below and in closely spaced relation with said base, a pair of strips integral with said sled and angularly inclined so that the ends thereof which are nearest said abutment element are disposed at a level below said base element and integral with said transverse connecting strip and the opposite ends thereof are disposed at a level above said base element and are interconnected with opposite ends of said transverse portion so that a horizontal force imparted to said article engaging panel in a direction away from said abutment element forces said transverse portion of said sled mounting portion downwardly into frictional contact with said flat planar surface of said base and forces said transverse connecting strip upwardly into contact with said base thereby to impede sliding movement of said sled in a direction away from said abutment element.

2. An adjustable device according to claim 1 wherein a reinforcing cross piece integral with said sled overlies said base element and whose ends extend downwardly to connect with the adjacent ends of said pair of strips respectively.

3. An adjustable device according to claim 2 wherein said reinforcing cross piece includes a transverse aperture and wherein said transverse connecting strip is disposed below and in closely spaced relation to the bottom surface of said base element and in general coincidence with said transverse aperture.

4. An adjustable device according to claim 1 wherein a pair of holes are formed in said base element adjacent each end thereof for receiving respectively a pair of tie down cords for securing the device to a supporting element.

5. An adjustable device according to claim 1 wherein a sled bracing panel is arranged with its upper edge integral with the upper edge of said article engaging panel and which slopes downwardly in a direction away from said abutment element and which is integral with said transverse portion of said sled.

6. An adjustable device according to claim 1 wherein a cavity is formed in said sled for receiving a spring coil an outer end of which is disposed under a part of said sled and above said base element and secured to said base element adjacent said abutment element for imparting a force to said sled in a direction toward said abutment element.

7. An adjustable device according to claim 6 wherein said outer end of said spring coil is secured to an upstanding stud secured to said base element and wherein a notch is formed in said reinforcing cross piece for receiving said stud when said sled is disposed immediately adjacent said abutment element.

* * * * *